US005552677A

United States Patent [19]

Pagones

[11] Patent Number: 5,552,677

[45] Date of Patent: Sep. 3, 1996

[54] METHOD AND CONTROL CIRCUIT PRECHARGING A PLURALITY OF COLUMNS PRIOR TO ENABLING A ROW OF A DISPLAY

[75] Inventor: Andrew Pagones, Algonquin, Ill.

[73] Assignee: Motorola, Schaumburg, Ill.

[21] Appl. No.: 431,995

[22] Filed: May 1, 1995

[51] Int. Cl.[6] ..... G09G 3/00

[52] U.S. Cl. ..... 315/169.1; 315/169.3; 345/76

[58] Field of Search ..... 315/169.3, 349, 315/169.1, 58, 169.4; 345/76, 78, 77, 80

[56] References Cited

U.S. PATENT DOCUMENTS

| | | | |
|---|---|---|---|
| 4,999,618 | 3/1991 | Inada et al. | 340/781 |
| 5,122,881 | 6/1992 | Nishizawa et al. | 358/212 |
| 5,142,184 | 8/1992 | Kane | 313/309 |
| 5,210,472 | 5/1993 | Casper et al. | 315/349 |
| 5,300,862 | 4/1994 | Parker et al. | 315/169.1 |
| 5,404,081 | 4/1995 | Kane et al. | 315/169.1 |

*Primary Examiner*—Robert Pascal
*Assistant Examiner*—David Vu
*Attorney, Agent, or Firm*—Robert F. Hightower; Eugene A. Parsons

[57] ABSTRACT

A display (10) has pixels organized into columns (21, 22) and rows (26, 27, 28, 29). The columns (21, 22) are precharged to a reference voltage prior to enabling each of the rows (26, 27, 28, 29). The reference voltage is developed using a reference generator (45) and a buffer (46).

2 Claims, 2 Drawing Sheets

METHOD AND CONTROL CIRCUIT PRECHARGING A PLURALITY OF COLUMNS PRIOR TO ENABLING A ROW OF A DISPLAY

BACKGROUND OF THE INVENTION

The present invention relates, in general, to display devices, and more particularly, to a method of controlling a display.

In the past, a variety of techniques have been utilized to control matrix addressed displays. Such displays typically have a plurality of pixel elements that are organized into a plurality of rows and columns. Information that is to be displayed typically is partitioned into groups of data to be applied to the columns wherein each group of data corresponds to a row of the display. Each group of data is then applied to the columns while the corresponding row is enabled. Subsequently another group of data corresponding to a subsequent row is applied to the columns while the subsequent row is enabled. This sequence is repeated until all information is displayed.

One problem with this technique is the large column capacitance that must be driven each time a row is enabled. The columns typically have a very large parasitic capacitance consequently, charging times for the columns is very long. The long charging time results in a non-linear display because a large portion of the line time is consumed charging the parasitic capacitance of the columns.

Accordingly, it is desirable to have a display control scheme that does not utilize a large portion of the display time to charge the columns, and that provides a linear display.

SUMMARY OF THE INVENTION

The present invention provides a new method and circuit of controlling a display including organizing a plurality of pixels into a plurality of columns and precharging the plurality of columns to a reference voltage value prior to enabling a row of the display, which includes forming the reference voltage by stimulating non-visible illumination from a reference field emission emitter, using a buffer to receive a voltage value of an input of the reference field emission emitter, and coupling an output of the buffer to the plurality of columns.

DETAILED DESCRIPTION OF THE DRAWINGS

Figure 1:
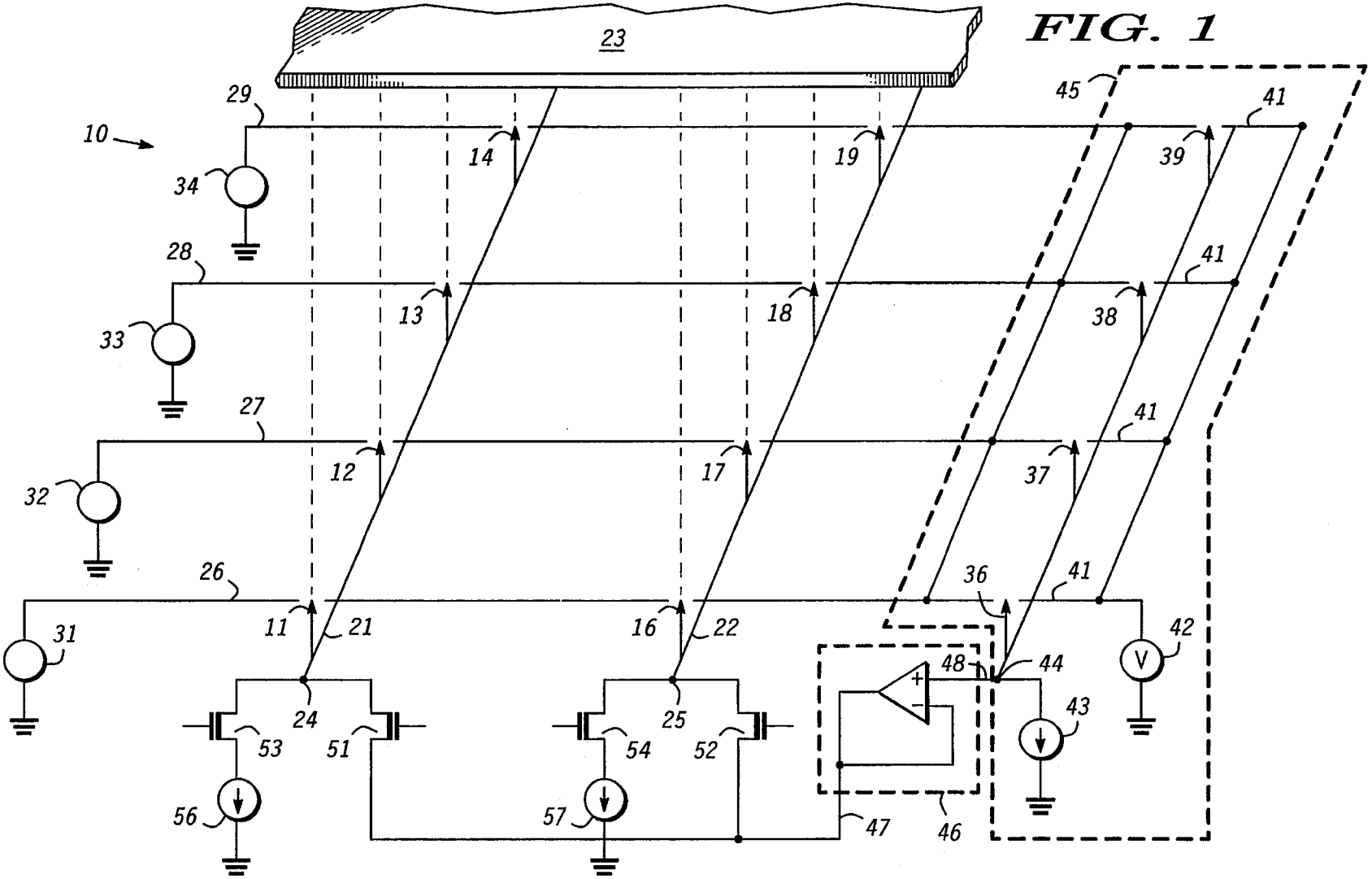
FIG. 1 schematically illustrates a portion of a field emission display in accordance with the present invention.

FIG. 1 schematically illustrates a portion of a field emission device display 10. Display 10 includes a first plurality of field emission emitters that includes field emission emitters 11, 12, 13, and 14 that are organized into a first column 21, and a second plurality of field emission emitters that includes field emission emitters 16, 17, 18, and 1! 9 that are organized into a second column 22. An anode 23 of display 10 overlays emitters 11, 12, 13, 14, 16, 17, 18, and 19 and has a phosphor coating on the side facing the first and the second plurality of field emission emitters so that emitters 11, 12, 13, 14, 16, 17, 18, and 19, each function as a pixel of display 10. Display 10 also includes a first emission gate or row 26, a second emission gate or row 27, a third emission gate or row 28, and a fourth emission gate or row 29 that organize emitters 11, 12, 13, 14, 16, 17, 18, and 19 into a matrix, and that are used to stimulate emission current from the first and second plurality of field emission emitters. Rows 26, 27, 28, and 29 are coupled to an output of voltage sources 31, 32, 33, and 34, respectively, so that rows 26, 27, 28, and 29 are enabled by sources 31, 32, 33, and 34, respectively. An example of a matrix addressed field emission device display is described in U.S. Pat. No. 5,142,184 issued to Robert C. Kane on Aug. 25, 1992.

In order to provide good display linearity and quickly charge parasitic capacitances associated with columns 21 and 22, display 10 precharges columns 21 and 22 to a reference voltage prior to enabling rows 26, 27, 28, and 29. A voltage follower or buffer 46, illustrated by a dashed box, is used to develop the reference voltage and charge columns 21 and 22. Buffer 46 receives an input voltage from a reference generator 45, illustrated by a dashed box, on an input 48 and produces the reference voltage on an output 47. Buffer 46 has a high input impedance, in excess of one hundred meg-ohms for example, to prevent from disturbing generator 45, and a very low output impedance that is sufficient to drive all the columns in a required amount of time, less than ten ohms for example. Input 48 is connected to an input 44 of a first reference field emission emitter 36, a second reference field emission emitter 37, a third reference field emission emitter 38, and a fourth reference field emission emitter 39. Emitters 36, 37, 38, and 39 are formed similarly to emitters 11, 12, 13, 14, 16, 17, 18, and 19. In order to prevent creating light on display 10, emitters 36, 37, 38, and 39 typically do not have an overlying portion of anode 23. However, if emitters 36, 37, 38, and 39 are biased to produce non-visible illumination, anode 23 can overlay emitters 36, 37, 38, and 39.

A voltage source 42 applies a voltage to a reference emission gate or row 41 that is approximately equal to the voltage applied by each of sources 31, 32, 33, and 34 in order to match the conditions applied by rows 26, 27, 28, and 29 to columns 21 and 22. A reference current source 43 has an output that is connected to input 44 in order to provide drive current for emitters 36, 37, 38, and 39. Source 43 provides a drive current value sufficient to produce a non-visible emission current from emitters 36, 37, 38, and 39, that is, an emission current that results in non-visible illumination of display 10. Consequently, input 44 charges to a non-visible illumination voltage value that is sufficient to provide such non-visible emission current. This non-visible illumination voltage value on input 44 is received by buffer 46 which produces a corresponding voltage or the reference voltage on output 47.

In operation, prior to enabling a row such as row 26, or 27, or 28, or 29, the reference voltage value on output 47 is coupled to both columns 21 and 22. Columns 21 and 22 have an input 24 and 25, respectively, that are coupled to output 47 by a precharge coupler 51 and a precharge coupler 52, respectively. After charging is complete, couplers 51 and 52 are disabled to disconnect columns 21 and 22 from buffer 46. Subsequently, one of rows 26, 27, 28, or 29 is enabled either just prior to or simultaneously with or just after enabling column drive couplers 53 and 54 to couple emitter current sources 56 and 57 to columns 21 and 22, respectively, in order to drive emitters 11, 12, 13, 14, 16, 17, 18, and 19 with the desired emission current.

Although generator 45 is shown having a plurality of emitters 36, 37, 38, and 39, generator 45 can have a single emitter. However, using multiple emitters in generator 45 compensates the reference voltage for manufacturing variations associated with a large number of emitters. Additionally, it should be noted that display 10 can have more than one buffer 46. For example, each column can have a separate buffer 46. The reference voltage can also have other values. However, lower values result in charging the column capacitance during the display time, and higher values can result in creating a false display if no data is to be displayed (i.e. no illumination) while the column discharges. Alternately, for higher reference voltage values, charging can be inhibited if no data is to be displayed.

Figures 2A, 2B, 2C, 2D:
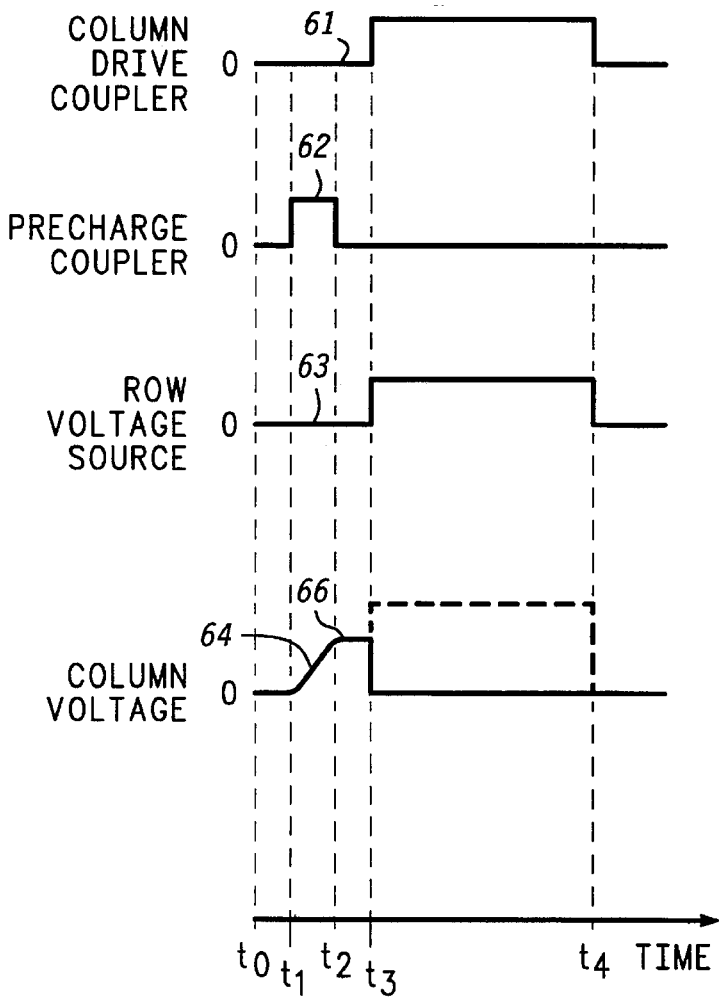
FIG. 2 is a timing diagram illustrating the operation of a portion of the display of FIG. 1 in accordance with the present invention.

FIG. 2 is a timing diagram illustrating the timing utilized in operating display 10 shown in FIG. 1. A TIME reference line represents time increasing from the left to the right of FIG. 2. At time to column drive couplers 53 and 54 are disabled as indicated by a column drive signal 61, and precharge couplers 51 and 52 are disabled as indicated by a precharge coupler signal 62. Also, row voltage source 31 (FIG. 1) is disabled as shown by a row voltage source signal 63. A column voltage signal 64 represents the voltage on either column 21 or column 22 (FIG. 1). Because source 31 is disabled, column voltage signal 64 begins at a low voltage in order to ensure that the first and the second plurality of emitters are disabled prior to enabling rows 26, 27, 28, and 29 (FIG. 1). At time $t_1$ precharge couplers 51 and 52 (FIG. 1) are enabled, as shown by signal 62, to apply the reference voltage on output 47 to columns 21 and 22. As shown by column voltage signal 64 between $t_1$ and $t_2$, the voltage on columns 21 and 22 is charged to the reference voltage, indicated by a point 66 on signal 64, thereby providing non-visible illumination from the first and second plurality of emitters. At time $t_2$ couplers 51 and 52 are disabled as shown by signal 62. At time $t_3$ drive current couplers 53 and 54 are enabled, as shown by signal 61, to apply current sources 56 and 57 (FIG. 1) to columns 21 and 22, respectively. Also, row voltage source 31 is enabled in order stimulate emission or visible illumination from emitters 11 and 16.

If there is data to be displayed on either column 21 or column 22, a drive current is applied to the corresponding column and the voltage of the column is driven to a value that stimulates visible illumination as shown by the solid line portion of column voltage signal 64 between $t_3$ and $t_4$. If there is no data to be displayed, a drive current is not applied and the column typically is driven (by circuitry not shown) to a voltage that ensures no emission current is produced, as shown by the dashed portion of signal 64 between $t_3$ and $t_4$. At time $t_4$ couplers 53 and 54 are disabled and rows 26, 27, 28, and 29 along with columns 21 and 22 typically are driven to zero by circuitry (not shown) to ensure no illumination of display 10. Subsequently, couplers 51 and 52 are enabled (not shown) to once again precharge columns 21 and 22 to the reference voltage (not shown) prior to enabling row 27.

For example, one particular display utilizes approximately one hundred volts for each of sources 31, 32, 33, 34, and 42, and approximately two microamps for each of sources 43, 56, and 57. The resulting reference voltage on output 47 of buffer 46 is approximately 80 volts.

The technique of charging the column capacitance prior to enabling a row of the display can be used with other drive schemes, such as pulse width modulation. For pulse width modulation, precharging would occur prior to enabling a particular row only if there is data to be displayed on a column for that particular row.

Additionally, the reference voltage would be same as the operating column voltage used to drive the column during the pulse width modulation. In such a case, anode 23 should not overlay emitters 36, 37, 38, and 39 to prevent creating visible illumination.

By now it should be appreciated that there has been provided a novel circuit and method for controlling a display. By pre-charging the columns in the intervening time between enabling rows, it is not necessary to charge the parasitic capacitance of the columns during the active display time. Consequently, more of the active display time is available for creating visible illumination. This results in a more linear display with less distortion and more usable gray levels. Also, larger displays can be produced because the associated peak capacitive power dissipation is reduced.

I claim:

1. A method of controlling a display comprising:

organizing a plurality of pixels into a plurality of columns; and precharging the plurality of columns to a reference voltage value prior to enabling a row of the display, which includes forming the reference voltage by stimulating non-visible illumination from a reference field emission emitter, using a buffer to receive a voltage value of an input of the reference field emission emitter, and coupling an output of the buffer to the plurality columns.

2. A method of controlling a display comprising:

precharging a plurality of columns of the display to a reference voltage value that provides non-visible illumination of the display prior to stimulating visible illumination of the display, wherein precharging the plurality of columns of the display to the reference voltage value includes forming the reference voltage by stimulating non-visible illumination from a reference field emission emitter, using a buffer to receive a voltage value of an input of the reference field emission emitter, and coupling an output of the buffer to the plurality of columns.

* * * * *